US007647917B2

(12) United States Patent
Matsuda

(10) Patent No.: US 7,647,917 B2
(45) Date of Patent: Jan. 19, 2010

(54) ENGINE FOR A VEHICLE AND VEHICLE EQUIPPED WITH AN ENGINE

(75) Inventor: Yoshimoto Matsuda, Kobe (JP)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 0 days.

(21) Appl. No.: 12/012,232

(22) Filed: Jan. 31, 2008

(65) Prior Publication Data

US 2008/0178846 A1 Jul. 31, 2008

(30) Foreign Application Priority Data

Jan. 31, 2007 (JP) ..... 2007-021693

(51) Int. Cl.
*F02M 63/02* (2006.01)
*F02M 63/00* (2006.01)

(52) U.S. Cl. ..... 123/447; 123/456

(58) Field of Classification Search ..... 123/447, 123/456, 509; 138/26, 30
See application file for complete search history.

(56) References Cited

U.S. PATENT DOCUMENTS 5,333,524 A * 8/1994 Goforth ..... 82/127
5,967,120 A * 10/1999 Blanton et al. ..... 123/467
6,609,499 B2 * 8/2003 Kabat et al. ..... 123/432
6,904,894 B2 * 6/2005 Serizawa et al. ..... 123/467
7,021,290 B2 * 4/2006 Zdroik et al. ..... 123/456
2002/0096223 A1 * 7/2002 Schaefer ..... 138/30
2005/0109323 A1 * 5/2005 Zdroik et al. ..... 123/456
2005/0263198 A1 * 12/2005 Kamada et al. ..... 138/30

FOREIGN PATENT DOCUMENTS

JP 1030521 * 2/1998
JP 2005-188386 7/2005
KR 2001044983 A * 6/2001

* cited by examiner

*Primary Examiner*—Mahmoud Gimie
(74) *Attorney, Agent, or Firm*—Alleman Hall McCoy Russell & Tuttle LLP

(57) ABSTRACT

An engine for a vehicle, which is configured to enable a combustion stroke to occur in a plurality of cylinders substantially simultaneously, comprises a fuel pipe coupled to a fuel supply source for storing a fuel, a plurality of fuel injectors which are attached to the fuel pipe to respectively correspond to the plurality of cylinders and are configured to inject the fuel to their associated cylinders, and a damper chamber which is provided at the fuel pipe and has an inner space connected to an inner space of the fuel pipe.

14 Claims, 8 Drawing Sheets

ENGINE FOR A VEHICLE AND VEHICLE EQUIPPED WITH AN ENGINE

BACKGROUND ART

In multi-cylinder engines, typically, a fuel feed system is configured so that a fuel is suctioned by a fuel pump from a fuel tank through a fuel pipe, and is fed through the fuel pipe to a fuel rail forming a part of the fuel pipe. The fuel rail supports fuel injectors corresponding to respective cylinders and distributes the fuel to the fuel injectors.

In some engines, simultaneous expansion occurs. The term "simultaneous expansion" means that a combustion stroke occurs in two or more cylinders substantially simultaneously. The simultaneous expansion has various advantages and has been employed before. When the simultaneous expansion occurs, the amount of the fuel consumed in the two or more cylinders is twice or more as large as that of the fuel consumed when expansion (hereinafter referred to as non-simultaneous expansion) occurs only in a single cylinder.

However, when the fuel is injected in the simultaneous expansion, a pressure within the fuel pipe including the fuel rail is reduced more significantly than in the non-simultaneous expansion, making an engine speed unstable in some cases.

SUMMARY OF THE INVENTION

According to an aspect of the present invention, there is provided an engine for a vehicle, which is configured to enable a combustion stroke to occur in a plurality of cylinders substantially simultaneously, comprising a fuel pipe coupled to a fuel supply source for storing a fuel; a plurality of fuel injectors which are attached to the fuel pipe to respectively correspond to the plurality of cylinders and are configured to inject the fuel to their associated cylinders; and a damper chamber which is provided at the fuel pipe and has an inner space connected to an inner space of the fuel pipe.

In such a configuration, since the damper chamber is disposed to be connected to the fuel pipe, it is able to absorb a fluctuation in a fuel feeding pressure in the fuel pipe coupled to the fuel injectors configured to inject the fuel substantially simultaneously. Thereby, the engine is able to run at a stable engine speed.

The damper chamber may be configured so that a sum of a volume of the damper chamber and a volume of a part of the fuel pipe at which the damper chamber is provided is larger than a volume of the fuel pipe required when the fuel is not injected from two or more fuel injectors substantially simultaneously. In this case, since the fuel pipe coupled to the fuel injectors configured to inject the fuel substantially simultaneously to enable the simultaneous expansion to occur has a sufficient inner volume, it becomes possible to suppress the fluctuation in the fuel feeding pressure in the simultaneous expansion. Thereby, the engine is able to run at a stable engine speed.

The damper chamber may be configured so that a sum of a volume of the damper chamber and a volume of a part of the fuel pipe at which the damper chamber is provided is not less than a volume obtained by multiplying a volume of the fuel pipe required when the fuel is not injected from two or more fuel injectors substantially simultaneously by the number of fuel injectors configured to inject the fuel substantially simultaneously. In this case, the fuel pipe can have an inner volume to correspond to the number of the fuel injectors configured to inject the fuel substantially simultaneously to enable the simultaneous expansion to occur, it becomes possible to suppress the fluctuation in the fuel feeding pressure in the simultaneous expansion.

At least a part of the damper chamber may be made of an elastic material so that a volume of an interior of the damper chamber is variable. Since the part of the damper chamber made of the elastic material is able to absorb the fluctuation in the fuel feeding pressure sufficiently, it becomes possible to suppress the fluctuation in the pressure more suitably.

The fuel pipe may include a fuel rail which is configured to retain the fuel injectors and to distribute the fuel from the fuel pipe to the fuel injectors. The damper chamber may be provided at the fuel rail. In this case, the damper chamber can be provided at the existing fuel rail. In addition, the damper chamber can be disposed depending on an installation space of the engine.

The damper chamber may be provided at an end portion of the fuel rail. In such a configuration, a space around the engine in the vicinity of the end portion of the fuel rail can be efficiently used.

The fuel rail may be a part of a plurality of fuel rails. In this case, when the damper chamber is formed by a pipe coupling the plurality of fuel rails to each other, this pipe is able to serve as the damper chamber.

The fuel injector may be attached to penetrate a wall surface of an air cleaner box configured to clean air taken in from outside and guided to a cylinder of the engine. In such a configuration, for example, when the engine is applied to a vehicle such as a motorcycle equipped with the air cleaner box, one or more fuel injectors provided inside the air cleaner box can be fastened to the fuel rail easily.

In this case, the fuel rail may be provided in contact with an outer wall surface of the air cleaner box. In such a configuration, reduction of the volume of the air cleaner box because of the presence of the fuel rail can be avoided.

In this case, furthermore, the fuel rail may have a rectangular fuel flow cross-sectional shape whose short sides extend in a direction in which the fuel rail protrudes from the outer wall surface of the air cleaner box. This makes it possible to efficiently use the space around the engine in the vicinity of the outer wall surface of the air cleaner box.

As should be appreciated from the foregoing, the engine of the present invention provides advantages when it uses twin injectors or it is applied to the vehicle such as the motorcycle having a relatively small installation space around the engine.

According to another aspect of the present invention, there is provided a vehicle comprising an engine which is configured to enable a combustion stroke to occur in a plurality of cylinders substantially simultaneously, the engine including a fuel pipe coupled to a fuel supply source for storing a fuel; a plurality of fuel injectors which are attached to the fuel pipe to respectively correspond to the plurality of cylinders and are configured to inject the fuel to their associated cylinders; and a damper chamber which is provided at the fuel pipe and has an inner space connected to an inner space of the fuel pipe. In such a configuration, since the damper chamber is disposed to be connected to the fuel pipe, it is able to absorb a fluctuation in a fuel feeding pressure in the fuel pipe coupled to the fuel injectors configured to inject the fuel substantially simultaneously. Thereby, the vehicle equipped with the engine is able to a travel at a stable engine speed.

The above and further objects and features of the invention will more fully be apparent from the following detailed description with accompanying drawings.

DETAILED DESCRIPTION OF THE PREFERRED EMBODIMENTS

Hereinafter, an engine and a vehicle equipped with the engine of the present invention will be described with reference to the drawings.

Figure 1:
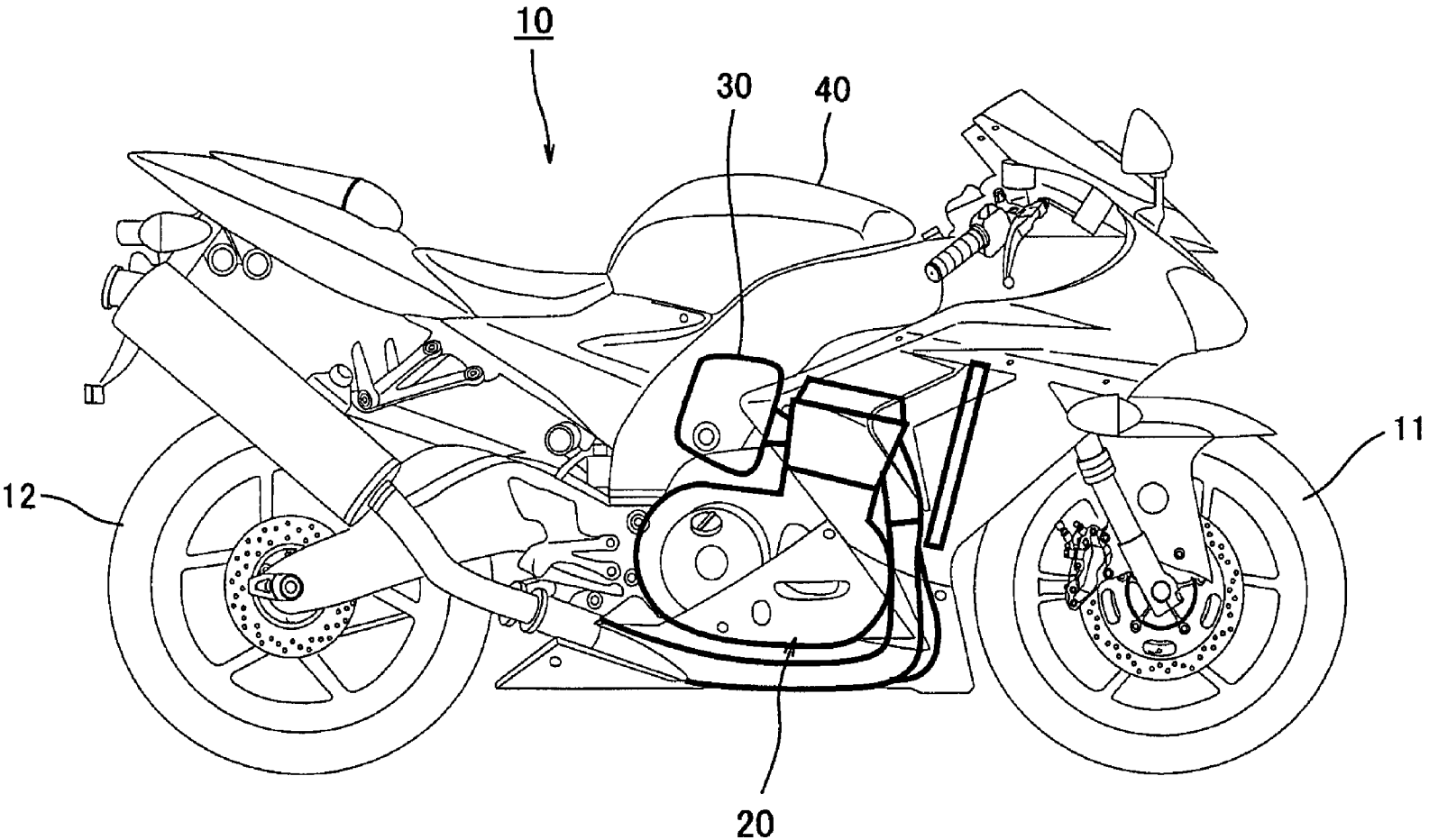
FIG. 1 shows a right side view showing a construction of a motorcycle according to an embodiment of the present invention.

FIG. 1 shows a right side view showing a construction of a motorcycle 10 according to an embodiment of the present invention. In the motorcycle 10, a front wheel 11 and a rear wheel 12 are mounted in front and rear positions of a main frame (not shown), and an engine 20, which is a driving source configured to drive the motorcycle 10, is mounted on the main frame. In addition, a fuel tank 40 is mounted on the main frame and is positioned above the engine 20.

The engine 20 of this embodiment is a fuel injection type four cylinder engine. The engine 20 is controlled by an ECU (electronic control unit) so that a combustion stroke occurs in two cylinders substantially simultaneously. The present invention is applicable to other suitable engines which are configured so that the combustion stroke occurs in two or more cylinders substantially simultaneously (hereinafter referred to as simultaneous expansion), as well as the engine 20.

In this embodiment, the engine 20 has exhaust ports (indicated by reference numeral 22 in FIG. 7) in front and intake ports (indicated by reference numeral 21 in FIG. 7) in rear. An air cleaner box 30 is coupled to the intake ports through a connecting pipe (indicated by reference numeral 211 in FIG. 7).

Figure 2:
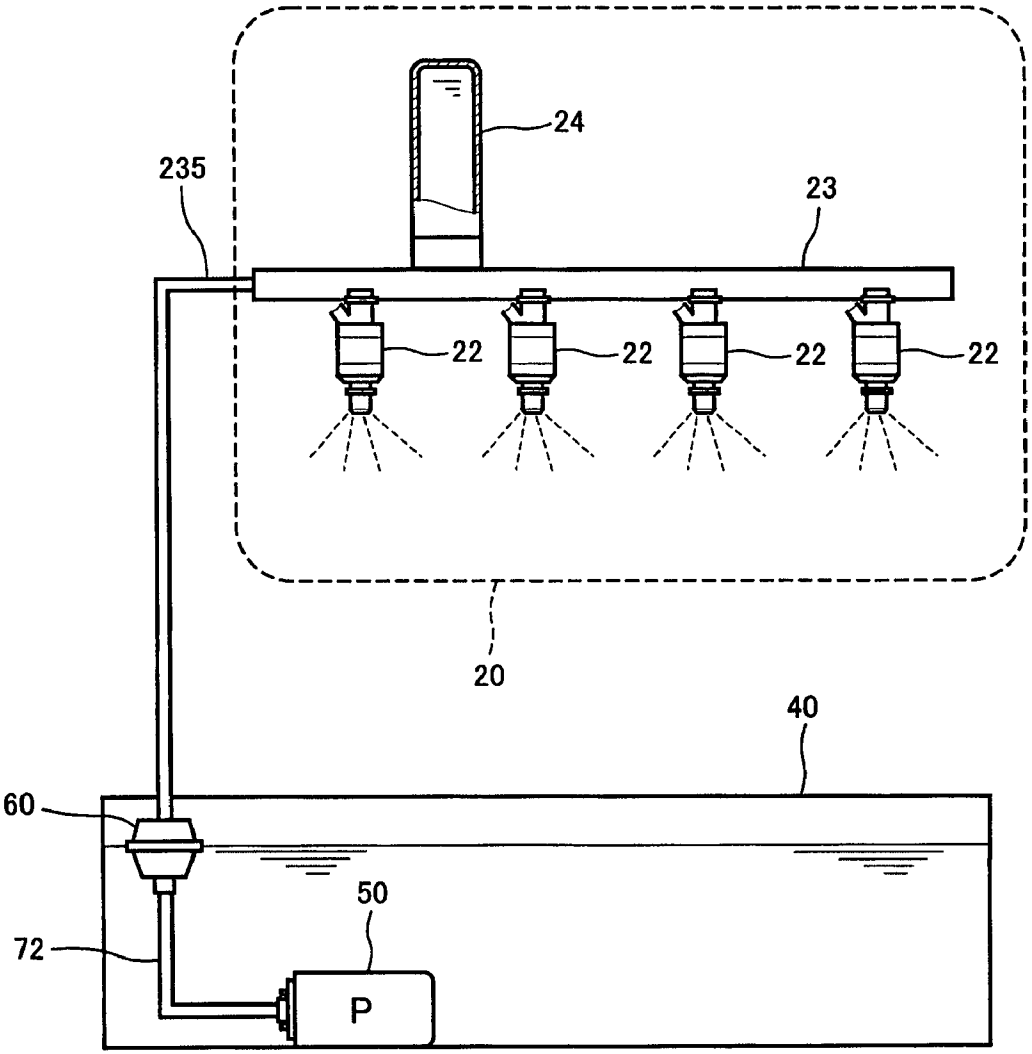
FIG. 2 shows a view schematically showing a construction of an engine of FIG. 1 according to the embodiment, in particular a fuel feed system thereof.

As shown in FIG. 2, a fuel feed system of the engine 20 of this embodiment includes the fuel tank 40 (see FIG. 1) which is a fuel feed source for storing a fuel, a fuel pump 50 which is typically accommodated within the fuel tank 40 and is configured to feed with a pressure the fuel from inside the fuel tank 40, a fuel-pressure regulator 60 configured to maintain the fuel fed with the pressure from the fuel pump 50 at a constant pressure, and a fuel rail 23 configured to distribute to fuel injectors 22 respectively corresponding to cylinders of the engine 20 the fuel maintained at the substantially constant pressure by the fuel pressure regulator 60.

As shown in FIG. 2, the fuel pump 50 is coupled to the fuel pressure regulator 60 through a fuel pipe 72, and the fuel tank 40 and the fuel pressure regulator 60 are coupled to the fuel rail 23 through a fuel pipe 235. The fuel pipe 72 and the fuel pipe 235 are flexible pipes. In this embodiment, the fuel pipes 72 and 235 and the fuel rail 23 are collectively referred to as a fuel pipe.

The fuel rail 23 is typically made of metal and has a volume allowing a sufficient fuel injection amount in non-simultaneous expansion, as in the conventional fuel rail.

Conventionally, the volume of the fuel rail 23 and the fuel pressure regulator 60 absorb a pressure fluctuation in fuel injection performed by the single fuel injector 22 in the non-simultaneous expansion. However, in such a structure, if the simultaneous expansion occurs, in particular in two cylinders, the pressure fluctuation tends to occur as described above.

To avoid this, in this embodiment, the fuel pipe is provided with a damper chamber 24 for absorbing the pressure fluctuation occurring in the simultaneous expansion. In this embodiment, the damper chamber 24 is disposed in an intermediate location of the fuel rail 23.

The damper chamber 24 has an inner space connected to an inner space of the fuel rail 23. The inner space of the damper chamber 24 is able to absorb the pressure fluctuation irrespective of the magnitude of its volume. In order to make sure that the damper chamber 24 absorbs the pressure fluctuation, it is required that a sum of an inner volume of the fuel rail 23 and the damper chamber 24 be set to at least an inner volume obtained by multiplying a volume of the fuel pipe required when two or more fuel injectors do not inject the fuel substantially simultaneously, by the number of the fuel injectors 22 which inject the fuel substantially simultaneously. In other words, in cases where the simultaneous expansion occurs in two cylinders and the fuel rail 23 has a volume equal to that of the existing fuel rail, the damper 24 is required to have an inner volume substantially equal to or larger than that of the fuel rail 23. The relationship is represented by: (volume of fuel pipe for the simultaneous expansion, or in this embodiment volume of the fuel rail)+(volume of damper chamber) $\geqq$(number of cylinders for simultaneous expansion)×(volume of fuel pipe in non-simultaneous expansion).

In another embodiment, the damper chamber 24 may have a casing whose inner volume is variable. To be specific, the casing may be formed of an elastic material such as rubber.

Figure 3:
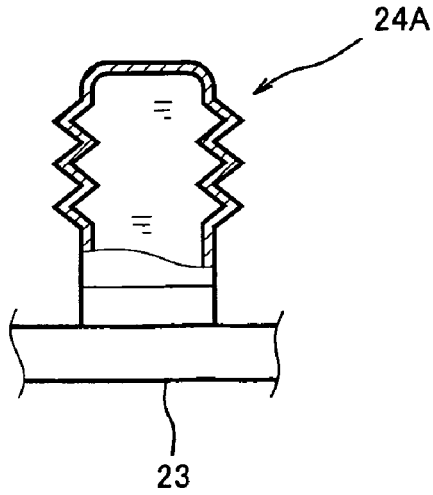
FIG. 3 shows a view showing another structure of a fuel rail of the engine of FIG. 2.

In another embodiment, as shown in FIG. 3, a bellows-like damper chamber 24A may be used. In that case, a casing of the damper chamber 24A may be formed like bellows using an elastic material such as rubber or synthetic resin.

Figure 4:
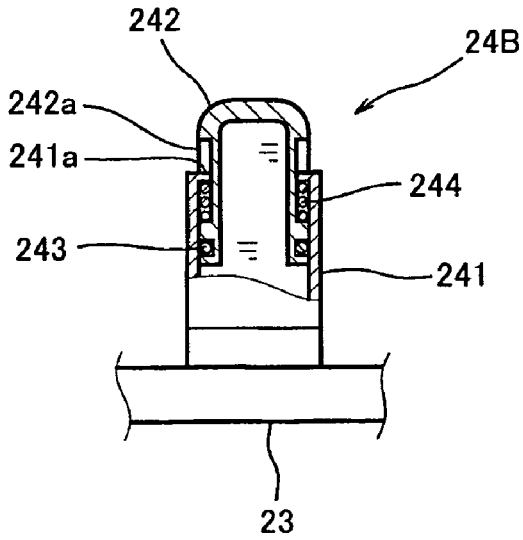
FIG. 4 shows a view showing another structure of the fuel rail of the engine of FIG. 2.

In another embodiment, as shown in FIG. 4, a telescopic sliding damper chamber 24B may be used. To be specific, the damper chamber 24B includes an outer tubular portion 241 which is provided at the fuel rail 23 and has an open tip end, an inner tubular portion 242 which is slidably internally fitted from the open tip end of the outer tubular portion 241 and has a closed tip end, a seal ring 243 provided in a liquid-tight condition between the outer tubular portion 241 and the inner tubular portion 242, and a spring 244 which is a biasing mechanism interposed between the outer tubular portion 241 and the inner tubular portion 242. The outer tubular portion 241 and the inner tubular portion 242 are made of metal or synthetic resin, while the seal ring 243 is made of an elastic material such as rubber or silicon.

The outer tubular portion 241 has a stopper protrusion 241*a* protruding inward toward the inner tubular portion 242. The inner tubular portion 242 has a sliding groove 242*a* in which the stopper protrusion 241*a* is disposed. Since a vertical dimension of the sliding groove 242*a* is larger than a vertical dimension of the stopper protrusion 241*a*, the inner tubular portion 242 is vertically slidable relative to the outer tubular portion 241. The spring 244 is accommodated in the sliding groove 242*a* and is configured to apply a force to the inner tubular portion 242 in a direction to decrease the volume of the damper chamber 24B. In this construction, when the pressure within the fuel rail 23 is decreased because of the fuel injection performed by the fuel injector 22, the volume of the damper chamber 24A is reduced actively to reduce the pressure fluctuation.

Figure 5:
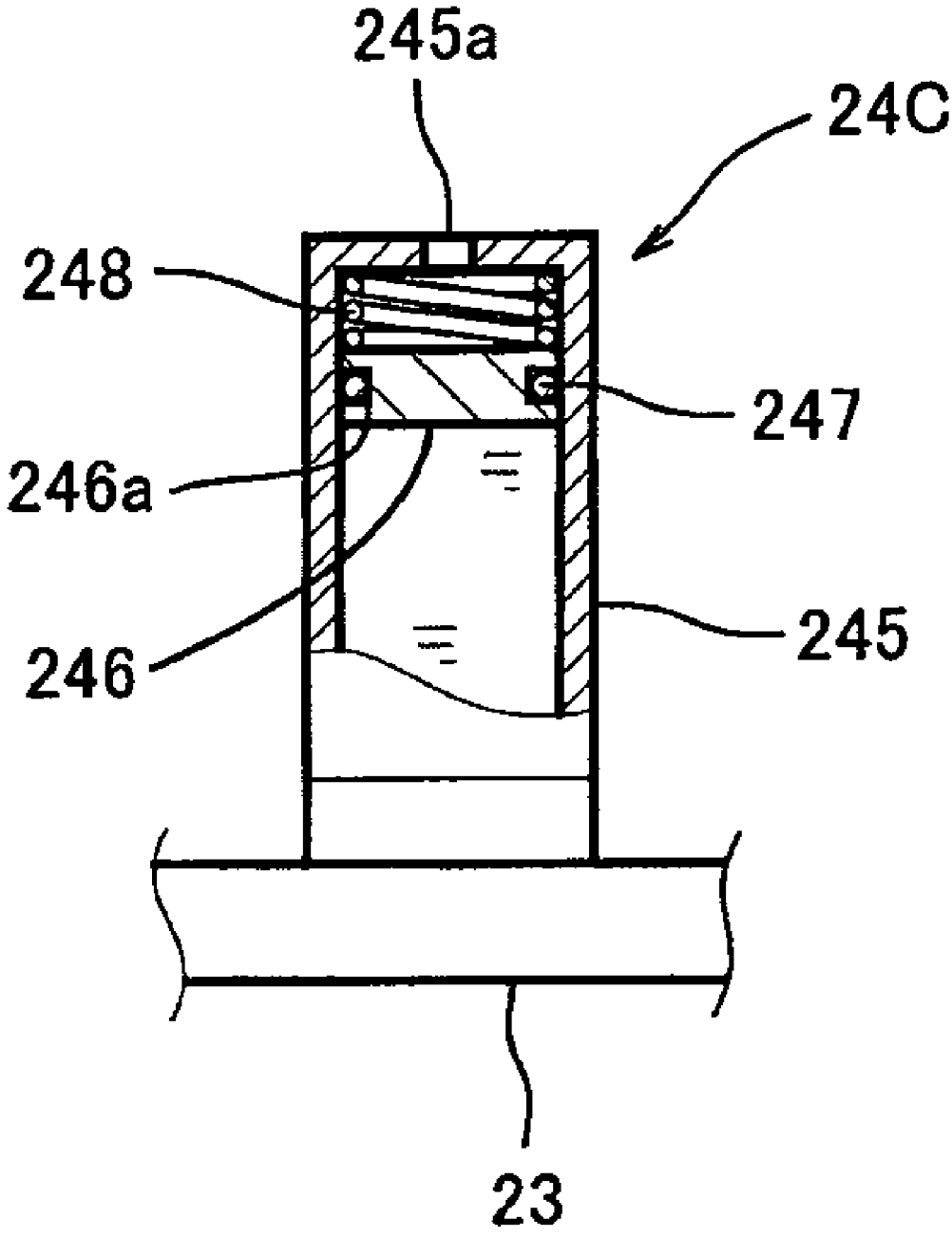
FIG. 5 shows a view showing another structure of the fuel rail of the engine of FIG. 2.

In another embodiment, as shown in FIG. 5, a piston-type damper chamber 24C is used. To be specific, the damper chamber 24C includes a cylinder 245 provided on the fuel rail 23, a piston 246 slidably internally fitted in the cylinder 245, a seal ring 247 provided in a liquid-tight condition between the cylinder 245 and the piston 246, and a spring 248 configured to apply a force to the piston 246 toward the fuel rail 23. An air hole 245*a* is provided on a wall surface of the cylinder 245 which is on an opposite side of the fuel rail 23. In this construction, when the pressure within the fuel rail 23 is decreased because of the fuel injection performed by the fuel injector 22, the volume of the damper chamber 24C is reduced actively to reduce the pressure fluctuation.

Figure 6A:
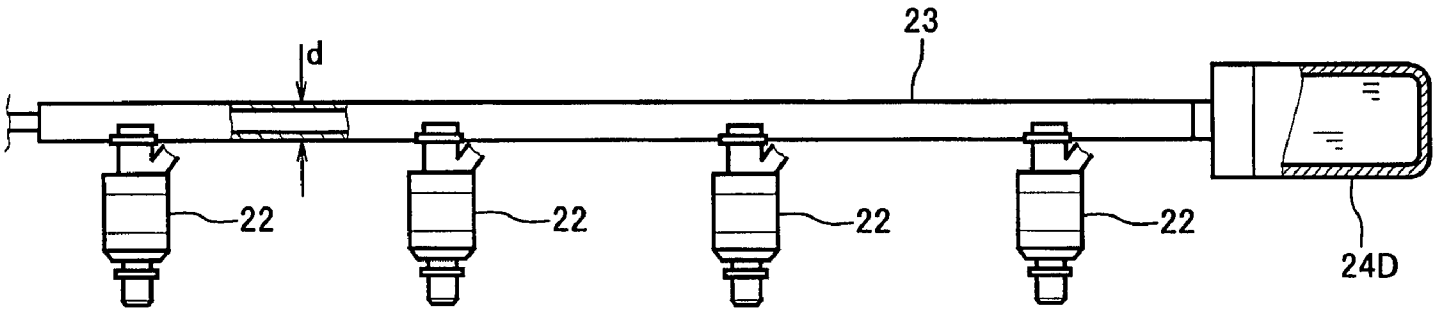
FIG. 6A shows a view showing another structure of the fuel rail of the engine of FIG. 2.

In another embodiment, as shown in FIG. 6A, a damper chamber 24D having a similar construction is positioned at an end portion of the fuel rail 23. Thus, the damper chamber 24D can be positioned more flexibly when applied to the motorcycle 10 of this embodiment having a very narrow installation space.

Figure 6B:
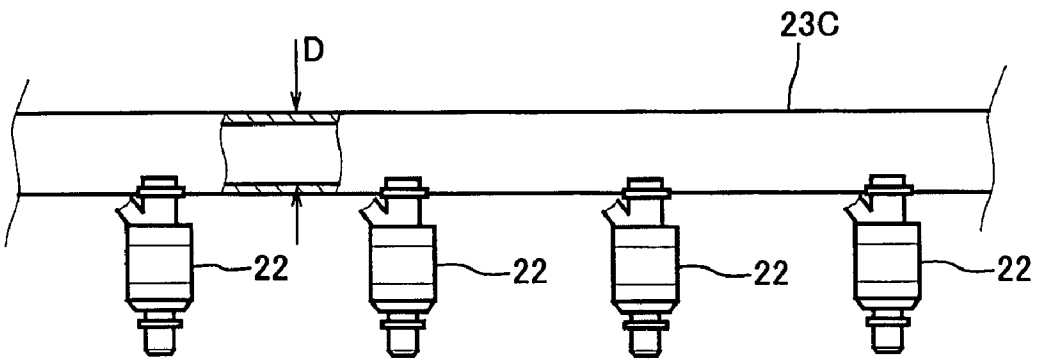
FIG. 6B shows a view showing another structure of the fuel rail of the engine of FIG. 2.

In another embodiment, as shown in FIG. 6B, the volume of the damper chamber may be incorporated into the fuel rail 23C. In that case, the fuel rail 23C has a volume which is more than twice as large as the volume of the fuel rail in the non-simultaneous expansion which is shown in FIG. 2 and FIG. 6A.

For example, when an inner diameter of the fuel rail 23 having a circular-cross section is d as shown in FIG. 6A, a fuel flow cross-sectional area Ad of the fuel rail 23 is $Ad=(\pi d^2)/4$. On the other hand, when an inner diameter of the fuel rail 23C is D as shown in FIG. 6B, a fuel flow cross-sectional area As of the fuel rail 23C is $As=(\pi D^2)/4$. In this case, therefore, the fuel flow cross-sectional area As of the fuel rail 23C is required to satisfy $As \geqq 2Ad$.

In general, a fuel pipe equipped in a motorcycle has an inner diameter of about 6 mm to 8 mm, and a fuel rail has in many cases has an inner diameter of about 6 mm to 8 mm to correspond to the inner diameter of the fuel pipe. So, in cases where the simultaneous expansion occurs in two cylinders like this embodiment, the fuel rail 23 incorporating a function of the damper chamber has an inner diameter of about 8.5 mm to 11.3 mm.

Figure 7:
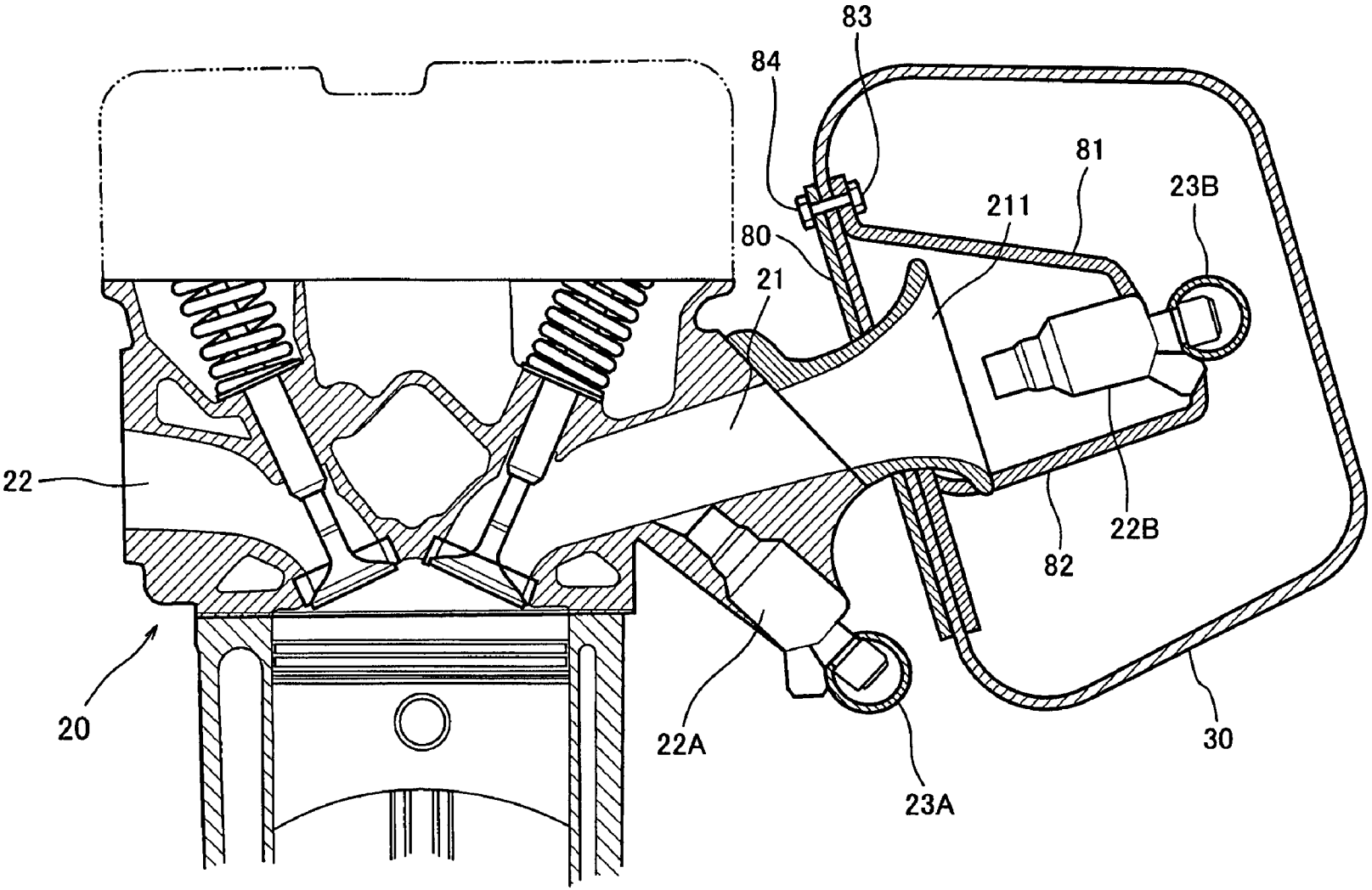
FIG. 7 shows a view schematically showing another structure of the engine of FIG. 1, and a twin-injector engine.

In another embodiment, as shown in FIG. 7, the engine 20 is a twin-injector engine equipped with two fuel injectors which are arranged upstream and downstream in a flow direction of air-intake for each cylinder. FIG. 7 shows a partial cross-section of the engine 20 in which the intake port 21 is located on the right side (rear in the motorcycle 10) and the exhaust port 22 is located on the left side (front in the motorcycle 10). The other cylinders have the same configuration as that shown in FIG. 7, although the configuration corresponding to the single cylinder is illustrated in FIG. 7 for the purpose of simply illustrating the cross-section.

A main fuel injector 22A in a first (lower) stage is attached to a position of the intake port 21 located on the right side. The air cleaner box 30 is coupled to the intake port 21 through a suitable connecting pipe 211. A sub fuel injector 22B in a second (upper) stage is disposed inside the air cleaner box 30 to face an air inlet of the connecting pipe 21. The sub fuel injector 22B and its associated fuel rail 23B are fastened to the air cleaner box 30 by stays 81 and 82. The stays 81 and 82 are fastened to the air cleaner box 30 by a bolt 83 and a nut 84 to sandwich a wall surface of the air cleaner box 30 between the stays 81 and 82 and a rigid plate 80 attached to an outer surface of the air cleaner box 30.

Figure 8:
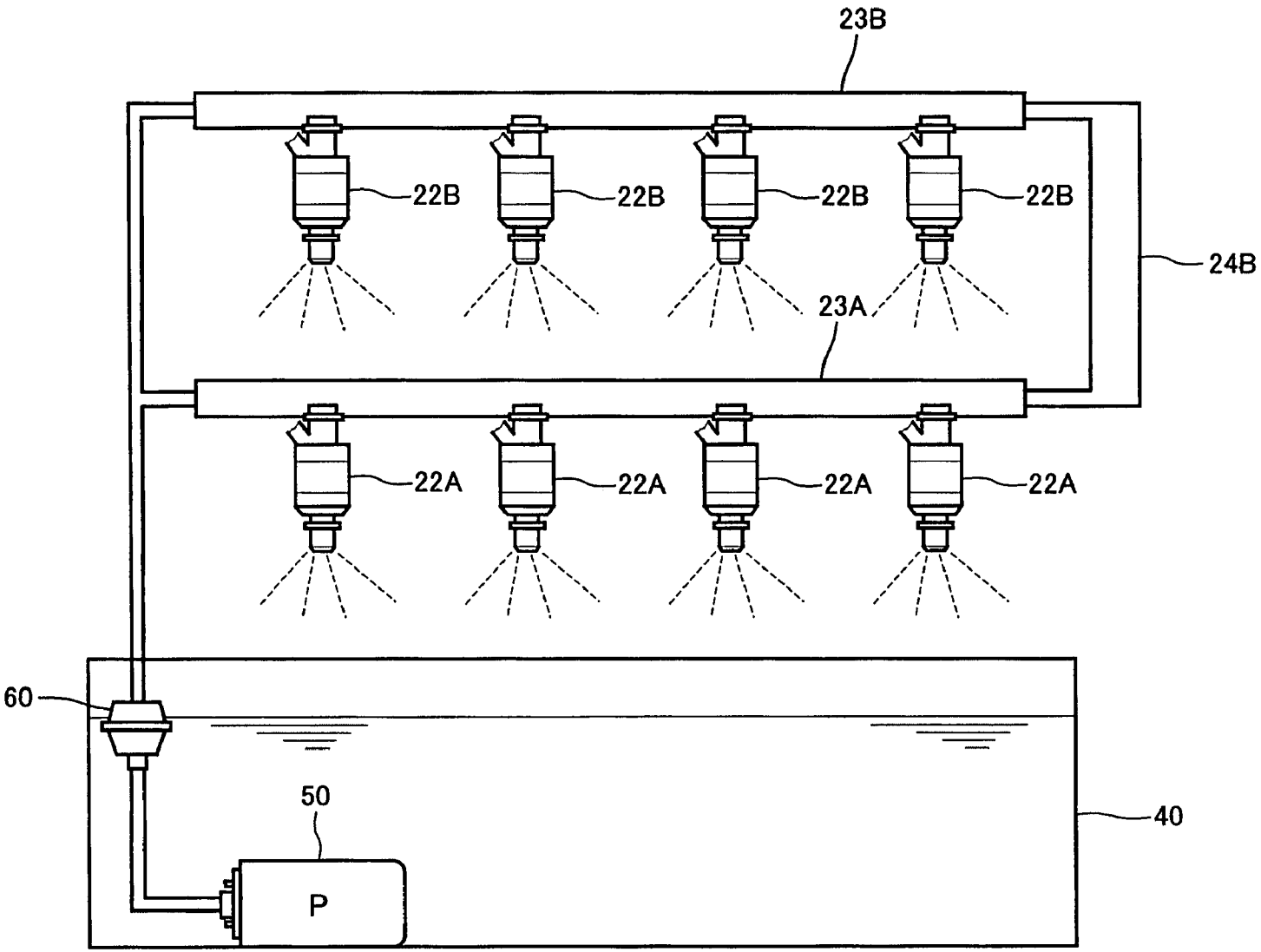
FIG. 8 shows a view schematically showing a fuel feed system for the engine according to the embodiment, which is applied to the twin-injector engine of FIG. 7.

Since the construction of the fuel feed system of the twin injector type shown in FIG. 7 is generally known, a detailed description thereof is omitted. When the damper chamber of the present invention is applied to the fuel feed system of the twin injector type of FIG. 7, a damper chamber 24B may be formed as a pipe for coupling the fuel rails 23A and 23B to which the fuel injectors 22A and 22B in two stages are attached respectively, as shown in FIG. 8.

It is desirable that the damper chamber 24B also have a sufficient and variable volume as described above. Whereas the damper 24B is described as coupling the fuel rails 23A and 23B in two stages to each other, other suitable coupling configuration may be used if fuel rails in three or more stages are provided.

Figure 9A:
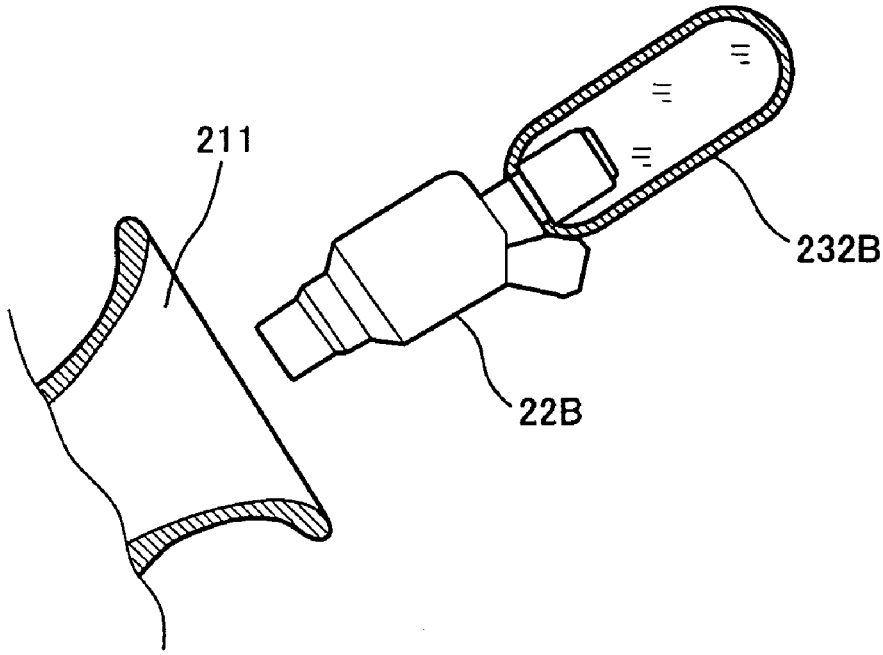
FIG. 9A shows a view showing a structure of a fuel rail which is a damper chamber of the engine according to the embodiment, which is applied to a fuel injector disposed within an air cleaner box.
Figure 9B:
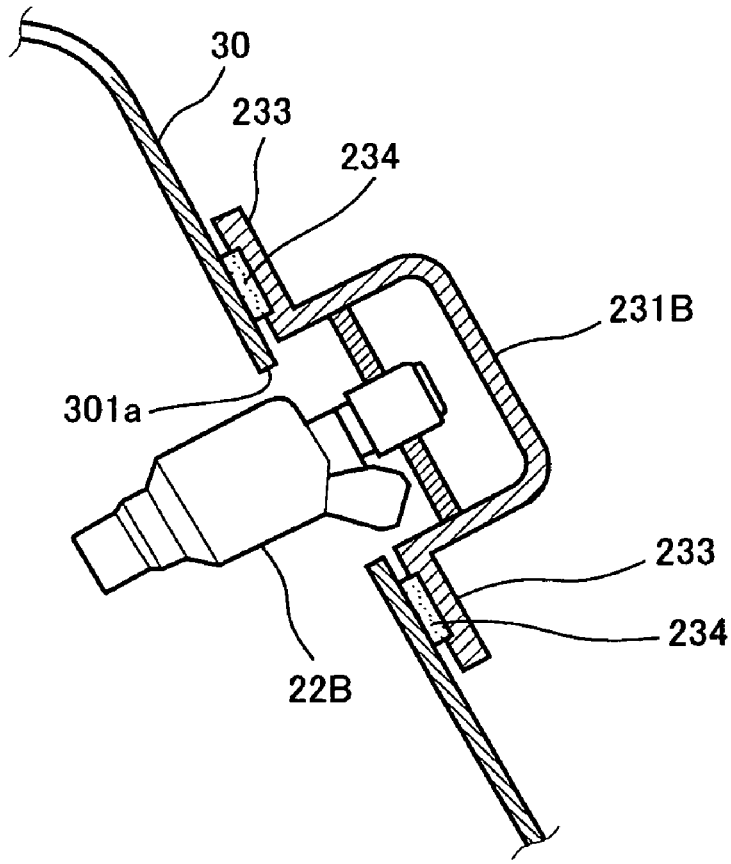
FIG. 9B shows a view showing another structure of the fuel rail of FIG. 9A.

As should be appreciated from the foregoing, when the fuel rail serves as the damper chamber, it is important that the fuel rail have a sufficient volume, and its cross-sectional shape may be arbitrary. For example, as shown in FIG. 9A, a fuel rail 232B may have an oval cross-sectional shape or an elongate-circle cross-sectional shape, other than the above described circular cross-sectional shape. In FIG. 9A, support structures for the fuel injector 22B and the fuel rail 232B are omitted.

When the fuel injector 22B is disposed inside the air cleaner box 30 as shown in FIG. 7, it is desirable that a connecting end portion of the fuel injector 22B with a fuel rail 231B penetrate a wall surface of the air cleaner box 30, and the connecting end portion be coupled to the fuel rail 231B outside the wall surface of the air cleaner box 30. To this end, an opening 301*a* through which a rear portion of the fuel injector 22B is inserted is formed on the wall surface of the air cleaner box 30.

The fuel rail 231B is mounted to an outer wall surface of the air cleaner box 30. The fuel rail 231B has a rectangular cross-sectional shape whose short sides extend in a direction in which the fuel rail 231B protrudes from the outer wall surface of the air cleaner box 30. The fuel rail 231B has a flange portion 233 which is mounted in a sealed condition to the outer wall surface of the air cleaner box 30 around the opening 301*a* with a seal member 234 interposed between the flange portion 233 and the outer wall surface of the air cleaner box 30. In such a configuration, since the fuel rail 231B has the above described rectangular cross-sectional shape, its volume can be increased although the fuel rail 231B protrudes with a small amount from the outer wall surface of the air cleaner box 30. In addition, the rectangular cross-sectional shape of the fuel rail 231B can improve stability with which the fuel rail 231B is supported by and mounted to the wall surface of the air cleaner box 301

Whereas in the above described embodiment, the motorcycle has been illustrated, the engine of the present invention is applicable to other vehicles such as all terrain vehicles (ATVs) or personal watercraft (PWC).

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An engine for a vehicle, which is configured to enable a combustion stroke to occur in a plurality of cylinders substantially simultaneously, comprising:

a fuel pipe coupled to a fuel supply source for storing a fuel;

a plurality of fuel injectors which are attached to the fuel pipe to respectively correspond to the plurality of cylinders and are configured to inject the fuel to their associated cylinders; and a damper chamber which is provided at the fuel pipe and has an inner space connected to an inner space of the fuel pipe;

wherein the fuel pipe includes a fuel rail which is configured to retain the fuel injectors and to distribute the fuel from the fuel pipe to the fuel injectors; and wherein the damper chamber is provided at the fuel rail and has an inner volume substantially equal to or larger than that of the fuel rail.

2. The engine according to claim 1, wherein the damper chamber is configured so that a sum of a volume of the damper chamber and a volume of a part of the fuel pipe at which the damper chamber is provided is larger than a volume of the fuel pipe required when the fuel is not injected from two or more fuel injectors substantially simultaneously.

3. The engine according to claim 1, wherein the damper chamber is configured so that a sum of a volume of the damper chamber and a volume of a part of the fuel pipe at which the damper chamber is provided is not less than a volume obtained by multiplying a volume of the fuel pipe required when the fuel is not injected from two or more fuel injectors substantially simultaneously by the number of fuel injectors configured to inject the fuel substantially simultaneously.

4. The engine according to claim 1, wherein at least a part of the damper chamber is made of an elastic material so that a volume of an interior of the damper chamber is variable.

5. The engine according to claim 1, wherein the damper chamber is provided at an end portion of the fuel rail.

6. The engine according to claim 1, wherein the fuel rail is a part of a plurality of fuel rails;

and wherein the damper chamber is formed by a pipe coupling the plurality of fuel rails to each other.

7. The engine according to claim 1, which is a twin injector type engine in which two fuel injectors are provided for each of the plurality of cylinders and are arranged in parallel in a flow direction of air-intake.

8. A vehicle comprising an engine which is configured to enable a combustion stroke to occur in a plurality of cylinders substantially simultaneously, the engine including:

a fuel pipe coupled to a fuel supply source for storing a fuel;

a plurality of fuel injectors which are attached to the fuel pipe to respectively correspond to the plurality of cylinders and are configured to inject the fuel to their associated cylinders; and a damper chamber which is provided at the fuel pipe and has an inner space connected to an inner space of the fuel pipe;

wherein the fuel pipe includes a fuel rail which is configured to retain the fuel injectors and to distribute the fuel from the fuel pipe to the fuel injectors; and wherein the damper chamber is provided at the fuel rail and has an inner volume substantially equal to or larger than that of the fuel rail.

9. The vehicle according to claim 8, further comprising:

an air cleaner box configured to clean air taken in from outside and guided to a cylinder of the engine;

wherein each of the fuel injectors is attached to penetrate a wall surface of the air cleaner box.

10. The vehicle according to claim 9, wherein the fuel rail is provided in contact with an outer wall surface of the air cleaner box.

11. The vehicle according to claim 10, wherein the fuel rail has a rectangular fuel flow cross-sectional shape whose short sides extend in a direction in which the fuel rail protrudes from the outer wall surface of the air cleaner box.

12. The vehicle according to claim 11, wherein an opening through which a rear portion of a fuel injector is inserted is formed on the wall surface of the air cleaner box; and wherein the fuel rail is mounted to an outer wall surface of the air cleaner box and has a flange portion which is mounted in a sealed condition to the outer wall surface of the air cleaner box around the opening with a seal member interposed between the flange portion and the outer wall surface of the air cleaner box.

13. The vehicle according to claim 8, wherein the fuel rail is a part of a plurality of fuel rails; and wherein the damper chamber is formed by a pipe coupling the plurality of fuel rails to each other.

14. The vehicle according to claim 12, wherein the fuel rail is part of a plurality of fuel rails; and wherein the damper chamber is provided at an end portion of the fuel rail and is formed by a pipe coupling the plurality of fuel rails to each other.

* * * * *